United States Patent [19]

Terrenzio

[11] Patent Number: 4,513,919

[45] Date of Patent: Apr. 30, 1985

[54] FEED ARRANGEMENT FOR A CENTRIFUGAL ROCK CRUSHER

[75] Inventor: Gabriel M. Terrenzio, Seattle, Wash.

[73] Assignee: Acrowood Corporation, Everett, Wash.

[21] Appl. No.: 553,218

[22] Filed: Nov. 18, 1983

[51] Int. Cl.[3] ..... B02C 19/00

[52] U.S. Cl. ..... 241/275; 241/285 A

[58] Field of Search ..... 241/275, 285 R, 285 A

[56] References Cited

U.S. PATENT DOCUMENTS 4,326,676 4/1982 Rose ..... 241/275

*Primary Examiner*—Mark Rosenbaum

*Attorney, Agent, or Firm*—Biebel, French & Nauman

[57] ABSTRACT

An improved feed arrangement is provided for use in a centrifugal impact rock crusher that includes a housing with a housing cover attached thereto having a circular housing feed opening defined therein concentric with a central axis. An impeller is rotated concentrically with the axis to throw rock received within the impeller against an impact surface within the housing to crush the rock. An impeller cover includes a circular impeller feed opening concentric with the axis and of a diameter substantially equal to that of the housing feed opening. The feed arrangement includes a hopper with a circular exit opening of a diameter substantially equal to that of the housing and impeller feed openings. The hopper is supported above the housing cover, and a cylindrical feed tube extends from within the hopper, through the exit opening and the housing feed opening and into the impeller feed opening. The feed tube is of a diameter slightly less than the openings through which it passes. The feed tube is releasably secured to the housing cover to permit downward adjustment of the feed tube as its bottom end wears.

7 Claims, 7 Drawing Figures

FEED ARRANGEMENT FOR A CENTRIFUGAL ROCK CRUSHER

BACKGROUND OF THE INVENTION

The present invention relates to impact-type crushers which utilize centrifugal force to hurl rocks to be crushed against an impact surface and, more particularly, to an improved rock feeding arrangement for such crushers.

Impact-type crushers utilizing centrifugal force to hurl rocks to be crushed are generally known. For example, in U.S. Pat. No. 4,126,280, issued Nov. 21, 1978, to Burk, rock is fed into a rotating impeller which hurls the rock against a plurality of anvils disposed in a ring concentric with the access of rotation of the impeller. As another approach, U.S. Pat. No. 3,970,257, issued July 20, 1976, to McDonald et al., a rotating impeller throws the rock against a bed of crushed rock instead of the anvils.

In either case, a primary design consideration is providing for a sufficient useful life span of the apparatus, particularly those portions of the apparatus which come in contact with the rock as it is passed through the device. For example, portions of the device, such as impeller vanes and upper and lower plates within the impeller, are subject to a great deal of wear while they are accelerating the rock. As a result, any portions subject to wear require periodic replacement, which necessitates substantial down time for the equipment and incurs considerable cost for replacement of worn parts.

One portion of the apparatus which is subject to wear is the feed arrangement for directing rock to be crushed into the impeller. In a typical crusher, a hopper is mounted atop the device with a feed tube extending downwardly from the hopper passing through an opening in an impeller cover plate. Rock to be crushed travels from the hopper through the feed tube and is directed to the impeller interior, from which it is thrown against the impact surface.

Considerable wear occurs on the hopper interior as the rock moves therefrom into the feed tube. Additionally, the interior of the lower end of the feed tube is particularly subject to wear, due to rock rebounding from the impeller interior, and since the rock is moving at its greatest speed as it exits the feed tube into the impeller. More importantly, dust and small particles from the rock as it enters the impeller tends to collect between the feed tube exterior and the opening through the impeller cover plate into which the feed tube extends. This material collects to such an extent that the clearance between the feed tube and impeller cover plate is entirely filled, which does provide some advantage in that the accumulated material serves as a seal to prevent the dust and small particles from entering the region above the impeller. Nonetheless, rotation of the impeller causes the accumulated material to quickly wear away the feed tube exterior, resulting in relatively frequent replacement of the feed tube.

What is needed, therefore, is a feed tube arrangement which enables use of a single feed tube for greater periods of time before replacement is required. Such an arrangement, of course, should not interfere with overall design of the remainder of the rock crusher and, preferably, should be capable of use with existing crushers on a retrofit basis.

SUMMARY OF THE INVENTION

In meeting the foregoing needs, the present invention provides an improvement for use in a centrifugal impact rock crusher that includes a cylindrical housing with a vertically disposed central axis. An impact surface is defined radially around the interior of the housing and transverse to the central axis. A housing cover plate is provided for attachment to the housing having a circular housing feed opening defined therein concentric with the axis. Impeller means includes a landing surface therein, and is disposed for rotation concentrically within the housing and adapted to throw rock received upon the landing surface against the impact surface for crushing. An impeller cover plate for attachment to the impeller means has a circular impeller feed opening defined therein concentric with the central axis and of a diameter substantially equal to the diameter of the housing feed opening.

The improvement in the crusher includes a hopper having at least one side wall with upper and lower edges, the hopper defining a circular exit opening at the bottom of the hopper having a diameter substantially equal to the diameters of the housing and impeller feed openings. The hopper is supported with the exit opening disposed above and concentric with the housing feed opening. A cylindrical feed tube having upper and lower ends of a diameter slightly less than the diameters of the exit opening and the housing and impeller feed openings is of a height greater than the distance between the exit opening and the impeller feed opening, but less than the distance between the upper edge of the hopper side wall and the landing surface of the impeller. The feed tube is disposed in vertical orientation to pass through the exit opening and the housing feed opening into the impeller feed opening. The upper end of the feed tube is within the hopper, and the lower end is at or below the impeller feed opening. The feed tube is releasably secured to the cover opening to permit downward adjustment of the feed tube as its bottom end wears.

The feed tube may be releasably secured by an encircling clamp attachable about the feed tube, with means for attaching the clamp to the housing cover. The clamp may include first and second identical halves, each of the halves having a semi-cylindrical flange with first and second ends and vertical radial flanges extending from the first and second ends perpendicular to the semi-cylindrical flange. The clamp halves are attachable about the feed tube by placement of the semi-cylindrical flanges against the exterior of the tube and connection of adjacent ones of the vertical radial flanges.

The improved feed arrangement may further include at least one keyway defined in vertical orientation along the exterior of the feed tube, extending from the bottom end of the tube through the impeller feed opening at least partially along the height of the tube. A scraper key is fitted within each of the keyways and extends therefrom radially with respect to the feed tube to a distance insufficient to cause the key to contact the edge of the impeller feed opening.

Accordingly, it is an object of the present invention to provide a centrifugal rock crusher having an improved feed arrangement in which the feed tube for directing rock to be crushed into the crusher impeller can be used for a long period of operation before requiring replacement; to provide such a crusher in which the extended feed tube life span is produced by enabling downward adjustment of the tube into the impeller as the bottom end of the tube wears; to provide such a crusher in which the feed arrangement can be provided without requiring significant design changes in the remainder of the crusher; and to provide a feed arrangement which may be used with such a crusher on a retrofit basis.

Other objects and advantages of the present invention will be apparent from the following description, the accompanying drawings, and the appended claims.

DETAILED DESCRIPTION OF THE PREFERRED EMBODIMENT

Figures 1, 2:
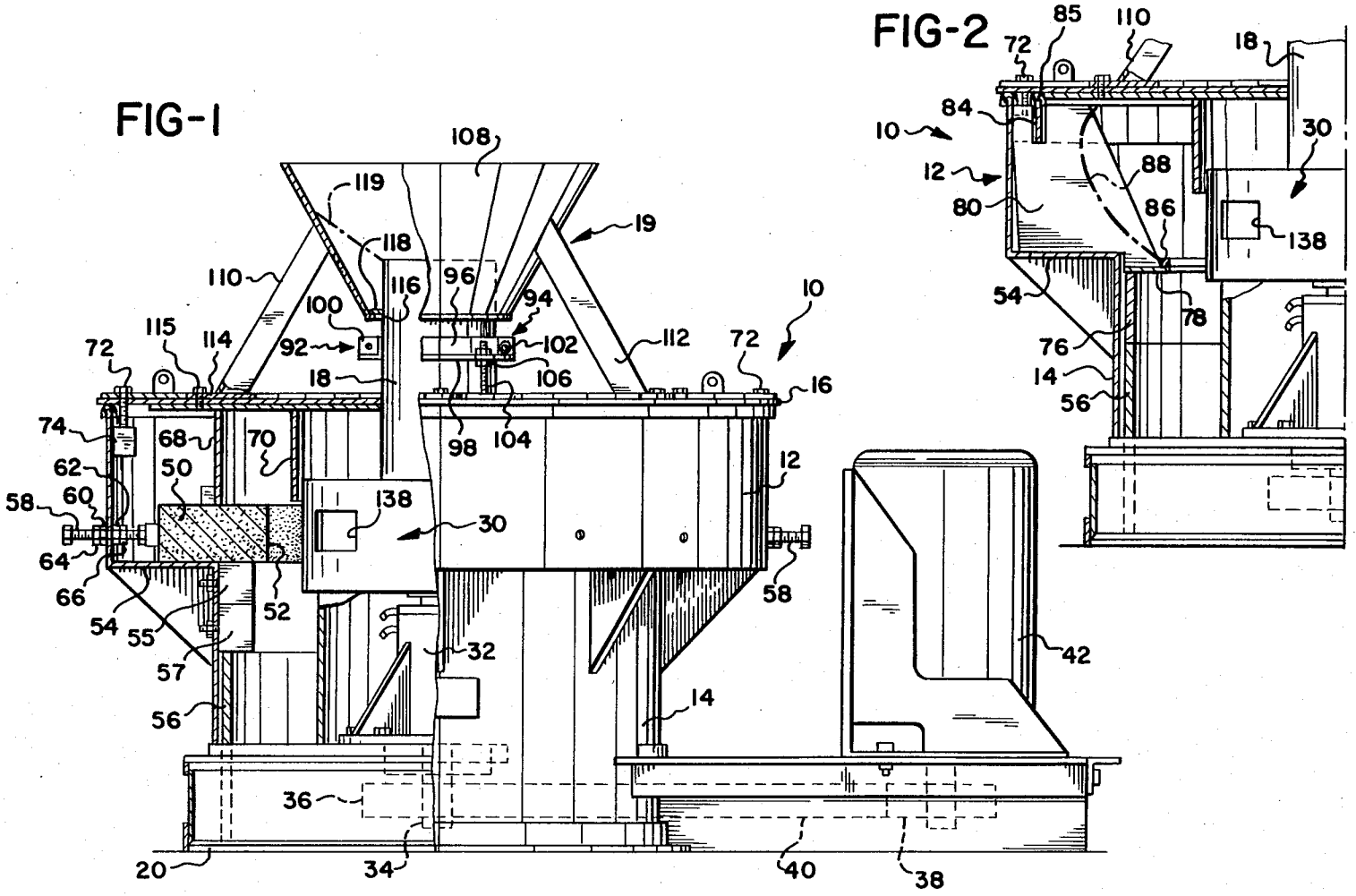
FIG. 1 is an elevational view in partial cross-section of a crusher utilizing anvils with which the feed arrangement of the present invention may be used.
FIG. 2 is a portion of a view similar to FIG. 1 showing a crusher utilizing a bed of rock material with which the feed arrangement may be used.

As best illustrated in FIG. 1, the rock crusher with which the feed arrangement of the present invention is used includes cylindrical housing 10 with concentric upper and lower portions 12 and 14. While the term "rock crusher" of course indicates apparatus for crushing rock, it should be recognized that a rock crusher of the type shown is equally capable of crushing glass, brick, concrete, asphaltic pavement material, and other rock-like materials.

Upper portion 12 is of somewhat larger diameter than lower portion 14 and is provided with a top cover plate 16 through which passes a central cylindrical feed tube 18. Feed tube 18 represents one portion of feed means 19 which directs rock to be crushed into the apparatus. The smaller diameter lower portion 14 of housing 10 is open at the bottom 20 in order to permit rock to be discharged from the apparatus once it has been crushed. The cylindrical housing 10 is usually positioned on top of a framework (not shown) which permits the rock to fall from the open bottom 20.

Disposed concentrically within housing 10 beneath the feed tube 18 is the impeller assembly 30 which is mounted for rotation in bearing support member 32. The impeller assembly 30 is driven by a central drive shaft 34 having one end extending down through bearing support member 32 into the lower portion of housing 10 where it is connected by pulleys 36 and 38 and V-belt 40 to the drive motor 42. Motor 42 thus rotates impeller assembly 30 at typical peripheral speeds for the assembly 30 in the range of 3500 to 20,000 feet per minute. As a result, considerable centrifugal force is generated within the impeller assembly 30.

Disposed concentrically around the impeller assembly 30 within the upper portion 12 of housing 10 are a plurality of adjustably positionable anvils 50. The anvils are disposed so that their end faces 52 form a generally cylindrical impact surface around the impeller assembly 30 against which the rock to be crushed is centrifugally thrown by the impeller assembly.

Each anvil 50 is supported by a shelf ring 54, and a cylindrical liner member 56 is positioned within the lower housing portion 14 to protect the wall of housing portion 14 from wear. In addition, rows of fixed anvils 55 and 57 are mounted to the inner wall of lower housing 14, providing further protection for housing 10 and partially supporting anvils 50.

A threaded bolt 58 is secured to the rear portion of the body of each anvil 50 and extends through a corresponding hole in the wall of upper portion 12. Inner and outer nuts 60 and 62 threadably engage the bolt 58 on each side of the wall of upper portion 12 in order to position each anvil 50 in a desired radial location and hold the anvil in that position. Passage of bolt 58 through the wall of upper portion 12 enables bolt 58 to be used in adjusting its corresponding anvil 50 inwardly as the end face 52 of the anvil wears. Nuts 60 and 62 are in turn secured by jam nuts 64 and 66, respectively.

A removable ring 68 is placed atop the anvils 50 within upper housing portion 12. Ring 68, when secured in place by fastening of cover 16 to upper housing portion 12, secures anvils 50 from any vertical movement during operation of the crusher. In addition, ring 68 serves to prevent rock from rebounding from end faces 52 of anvils 50 to the area behind the anvils. Similarly, ring 70, which is attached to the interior of cover 16, prevents rebounding rock from entering the area above impeller assembly 30.

Cover plate 16 is secured to upper housing portion 12 by a plurality of bolts 72 which pass through cover plate 16 and engage with threaded mounting blocks 74 secured to the inside surface of the wall of housing portion 12.

An alternative configuration for the rock crusher, and in particular for the impact surface region of the upper housing portion 12, is shown in FIG. 2. Rather than forming the impact surface from the end faces of a plurality of anvils, a bed of crushed rock is used. The exterior of upper housing portion 12, including shelf ring 54, is identical to that shown in FIG. 1. Moreover, as will be described below, the crusher housing 10 may be converted from use for a crusher operating with anvils to use for a crusher operating without anvils. Depending upon the type of rock to be crushed, it may be desirable to use the crusher either with or without anvils, with the conversion to be made when the type of rock being crushed is changed.

In particular, an auxiliary liner member 76 is positioned within lower housing portion 14, resting on liner member 56. A circular shelf extension ring 78 is positioned above auxiliary liner member 76, and in turn is supported by a plurality of gussets 80 which rest on shelf 54. Each gusset 80 is provided with a slot 82 into which is placed a cylindrical wear ring 84 that serves to protect bolts 72 from wear. Ring 84 also protects the upper portion of housing portion 12 from wear. An annular flange 86 is mounted to the innermost edge of shelf extension 78.

During operation of the rock crusher, rock is retained within upper housing portion 12 along shelf 54 and shelf extension 78 by annular flange 86. The accumulated rock assumes a configuration indicated generally by 88, and rock to be crushed is thrown by the impeller assembly 30 onto the rock bed. The crushed rock then drops through lower housing portion 14.

Figure 3:
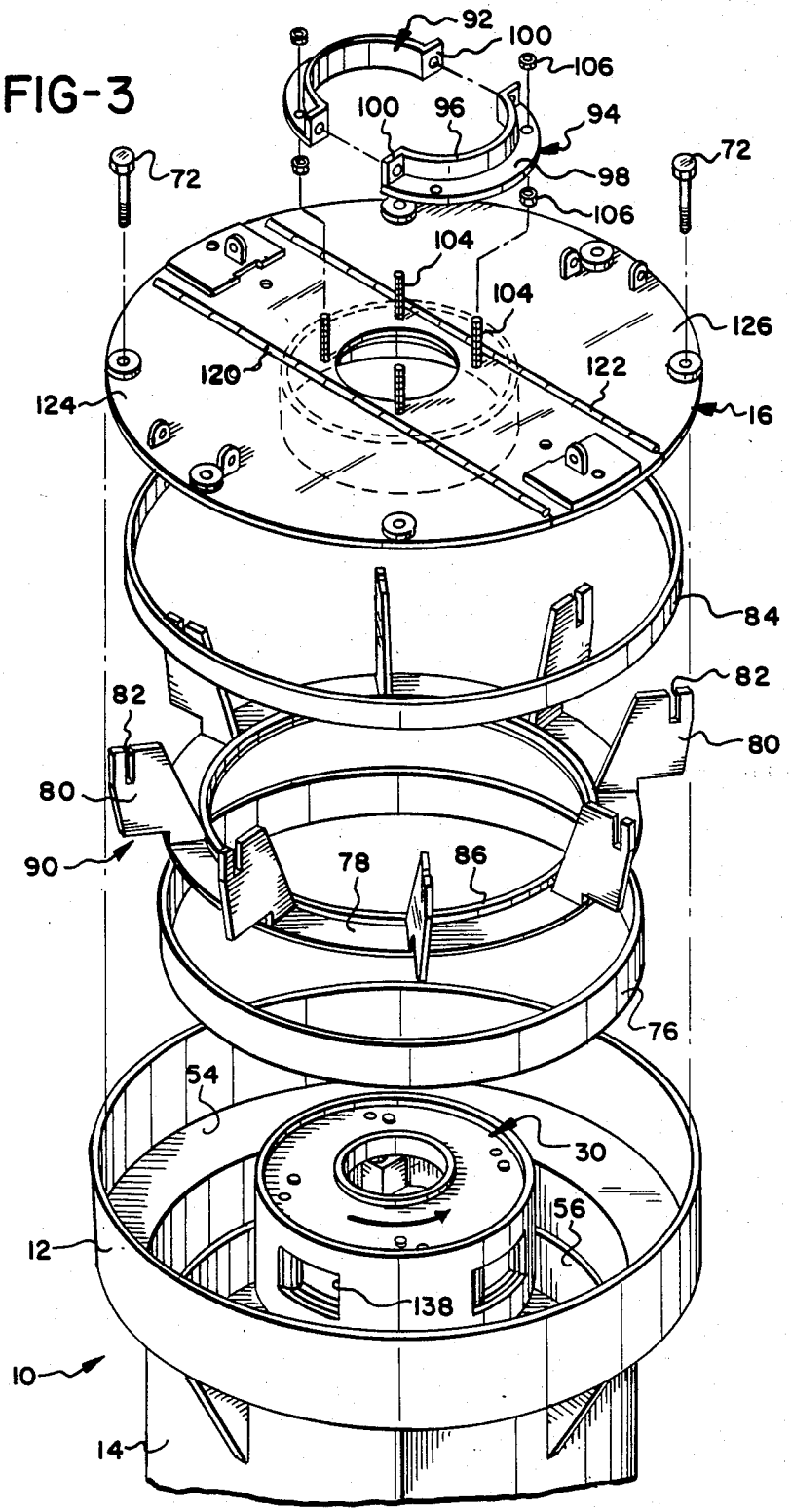
FIG. 3 is an exploded perspective view illustrating conversion of a crusher from a type utilizing anvils to a type utilizing a bed of rock material.

The conversion of the rock crusher from use with anvils to use without anvils can be seen in detail in FIG. 3. Referring briefly back to FIG. 1, the housing 10 is prepared by removal of cover 16 by loosening of bolts 72 from within mounting blocks 74. Ring 68 is removed from upper housing portion 12, and bolts 58 are detached from anvils 50. Anvils 50, bolts 58 and the associated nuts are removed from the housing, along with anvils 55 and 57 which are detached from lower housing portion 14. Openings in upper housing portion 12 for bolts 58 are then blocked by appropriate means (not shown).

As shown in FIG. 3, auxiliary liner member 76 is placed within lower housing portion 14 atop liner member 56, blocking the openings (not shown) within lower housing portion 14 for mounting of anvils 55 and 57. Shelf extension 78, flange 86, and gussets 80, which are all interconnected to form assembly 90, are placed into upper housing portion 12 so as to rest on shelf 54. Wear ring 84 is placed into slots 82 formed in gussets 80. Finally, cover plate 16 is replaced, and is secured by bolts 72.

Referring back to FIG. 1, feed means 19 includes feed tube 18, which has secured about it clamp halves 92 and 94 (see also FIG. 3). Clamp halves 92 and 94 are each identical, and include a semi-cylindrical flange 96 which is placed in contact with feed tube 18 and a horizontal flange 98 extending radially outwardly from semi-cylindrical flange 96. Vertical radial flanges 100 are mounted at each end of clamp halves 92 and 94, and are disposed perpendicularly with respect to both semi-cylindrical flanges 96 and horizontal flanges 98. Bolt 102 extends through each cooperating pair of vertical flanges 100 to secure clamp halves 92 and 94 about the tube 18.

A plurality of holes are formed through each horizontal flange 98. Threaded studs 104, which are fastened in upright fashion to cover plate 16, are placed through the holes formed in radial flanges 98. A pair of nuts 106 are placed on each stud 104, on opposite sides of radial flange 98, to secure feed tube 18 with respect to crusher housing 10.

Feed means 19 further includes a hopper 108 which has a pair of legs 110 and 112 extending downwardly from each side of hopper 108. Legs 110 and 112 terminate at mounting pads 114, which are in turn secured to cover plate 16 by bolts 115 or the like.

An annular bottom plate 116 is secured to the lower end of hopper 108. Bottom plate 116 includes a central opening 118 which is of slightly greater diameter than that of feed tube 18. Feed tube 18 extends through opening 118 into the interior of hopper 108 to a height substantially above bottom plate 116. Thus, as rock is fed into the crushing apparatus, a portion of the rock will be retained within hopper 108 in the portion thereof around the exterior of feed tube 18, indicated generally at 119. Thus, wear on the inside surface of hopper 108 as rock is placed therein is prevented by the rock retained within hopper 108.

Additionally, since feed tube 18 is not attached to either hopper 108 or bottom plate 116, the vertical positioning of feed tube 18 with respect to crusher housing 10 may be adjusted over small distances by movement of nuts 106 along each of studs 104. For vertical movement of feed tube 18 over larger distances, bolts 102 may be loosened, thereby releasing feed tube 18 from within clamp halves 92 and 94. Upon movement to a new position, bolts 102 are retightened. Thus, as the lower end of feed tube 18 is worn, as will be explained in detail below, feed tube 18 may be adjusted downwardly to provide greater time periods between complete replacement of feed tube 18.

Further, attachment of feed tube 18 by clamp halves 92 and 94 enables feed tube 18 to be removed for replacement by simply releasing clamp halves 92 and 94 from around the tube. The tube is then pulled upwardly through hopper 108, avoiding removal of the hopper structure as has been required in previous crushers.

Referring again to FIG. 3, it can be seen that cover plate 16 is provided with a pair of parallel hinges 120 and 122 extending the full width of cover plate 16. Thus, in the event it is necessary to gain access to the interior housing 10, for example, to observe inward adjustment of anvils, cover plate 16 need not be completely removed. In such a case, those of bolts 72 securing either or both of cover plate portions 124 and 126 are removed, whereupon portions 124 or 126 may be pivoted about hinges 120 or 122, as required.

Figure 4:
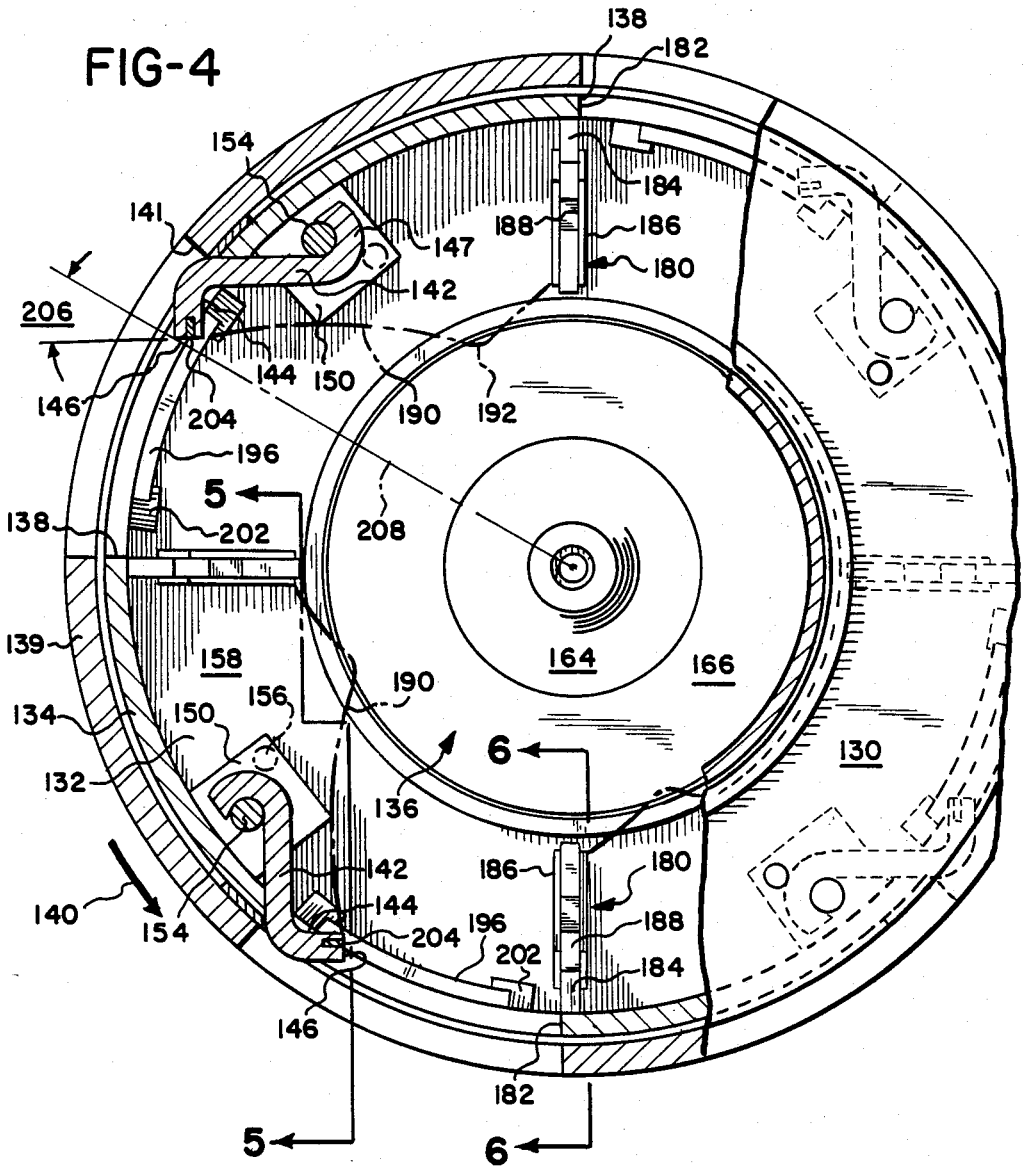
FIG. 4 is a top plan view of an impeller assembly for use with the crusher with a portion of the upper plate thereof removed.

The impeller assembly 30 may be seen in detail in FIGS. 4–7. As shown in FIG. 4, the impeller assembly 30 includes an upper plate 130, a lower member 132, and a generally cylindrical side wall 134 connected therebetween. A landing surface 136 is carried on lower member 132, upon which rock fed into the impeller assembly 30 through feed tube 18 impinges. A plurality of exit openings 138 are formed through side wall 134, spaced equidistantly therearound. Thus, as impeller assembly 30 is rotated in the direction indicated by arrow 140, rock impinging upon landing surface 136 will be thrown from impeller assembly 30 through exit openings 138. A wear ring 139 surrounds side wall 134 and is attached to upper plate 130. Wear ring 139 is provided with a number of openings 141 equal to the number of exit openings 138, with openings 141 being coincident with exit openings 138.

It will be recognized that, although four exit openings 138 are shown, as few as two openings may be provided, with the upper limit being determined by the size of the impeller assembly 30 and the desired production rate of the rock crusher. It should, of course, be clear that regardless of the number of exit openings used, the openings are to be spaced equally about side wall 134.

Means for defining a lip is provided adjacent each opening 138 in the form of an elongated lip member 142. A generally right-angled bend is provided near one end of lip body 142, so as to define a lip surface 144 and an end face 146. A curved bend 147 is provided in lip member 142 near its opposite end, providing a means for retaining the lip member 142 within the impeller assembly 30.

Figure 5:
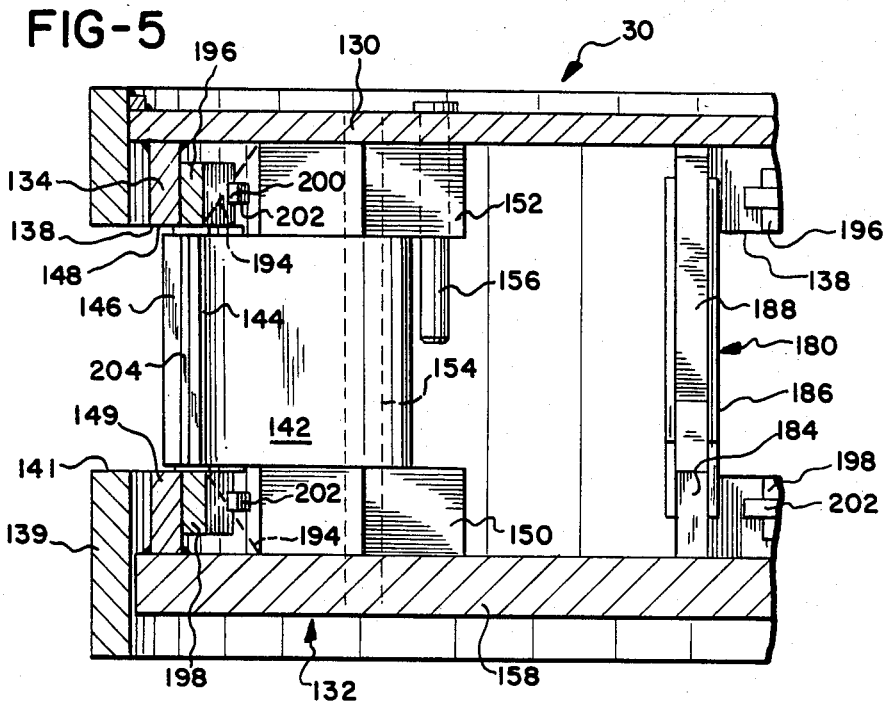
FIG. 5 is a sectional view taken generally along line 5—5 of FIG. 4.

As seen in FIG. 5, lip member 142 is of a height substantially equal to the height of each opening 138. Openings 138 are formed, however, so that the upper and lower edges 148 and 149, respectively, are remote from the upper plate 130 and lower surface 132.

A lower support block 150 and an upper support block 152 are secured to the impeller interior near each opening 138. Lower and upper blocks 150 and 152 are mounted in mutual vertical alignment, and are each of a height such that the space defined therebetween is of a height equal to that of opening 138 and is positioned with respect to side wall 134 at a height identical to opening 138. A cylindrical pin 154 extends between blocks 150 and 152. The curved bend 147 of lip body 142 is engageable with pin 154, as shown in FIG. 4, so that lip body 142 may be secured within impeller assembly 30 by engagement with pin 154. In addition, lip body 142 is placed adjacent the rearward side edge of opening 138 with respect to the direction of rotation of the impeller assembly 30. As impeller assembly 30 is rotated, centrifugal forces will operate to hold the lip bodies 142 firmly in position. Of course, it will be recognized that other means for securing lip body 142 may be used in place of pin 154, such as fixed abutments or pins of other cross-sectional shape. (Those skilled in the art may better recognized the rearward side edge of each opening 138 with respect to the direction of rotation of impeller assembly 30 as the leading edge of one of the rock traps, i.e., the leading edge of the portion of side wall 134 defined by two adjacent exit openings 138. In like manner, the forward side edge of each opening 138 may be recognized as the trailing edge of such a side wall portion or rock trap.)

To retain lip bodies 142 in position as impeller 140 is stopped, a removable pin 156, which may be formed from a bolt, extends downwardly from upper mounting block 152 along an upper portion of the height of lip body 142.

Figure 6:
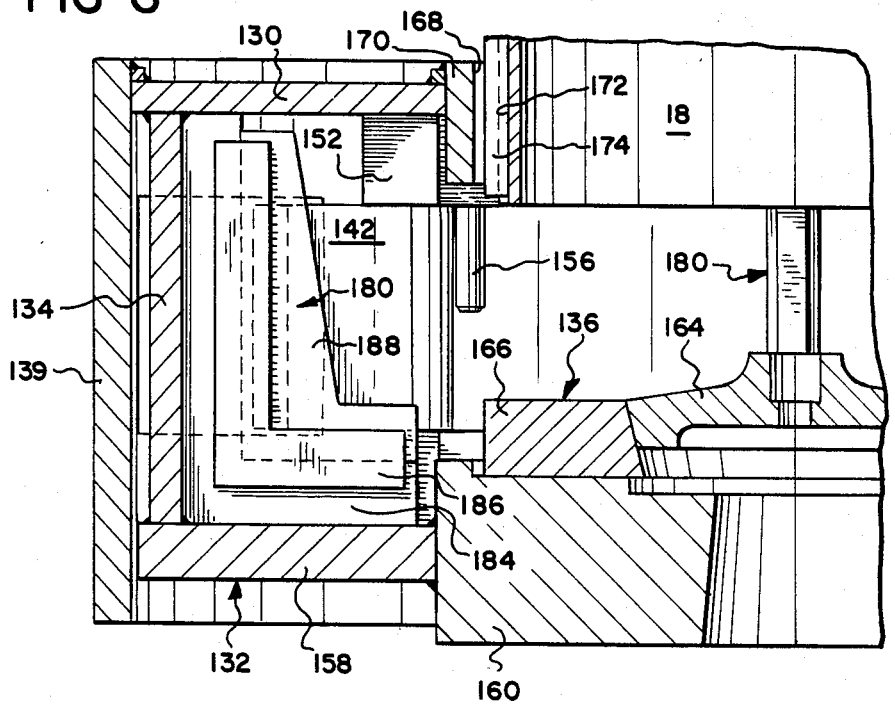
FIG. 6 is a sectional view taken generally along line 6—6 of FIG. 4.
Figure 7:
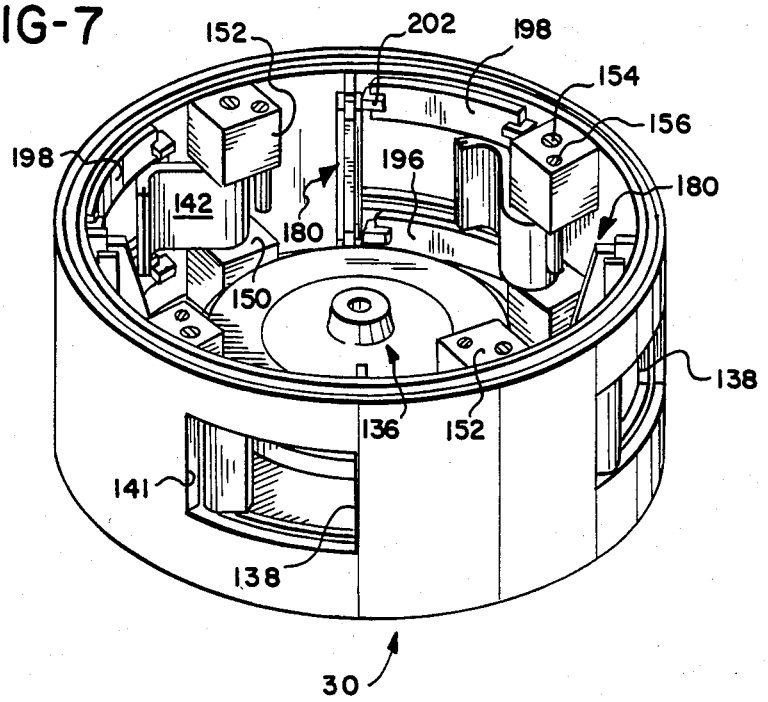
FIG. 7 is a perspective view of the impeller assembly with the upper plate removed.

Referring to FIG. 6, lower impeller surface 132 includes a lower plate 158 secured to a central circular block 160 having a central opening for passage therethrough of drive shaft 34. Circular block 160 carries thereon landing surface 136, including a landing cone 164 about which is disposed an annular landing ring 166, having either a flat surface as shown or, alternatively, a conical surface. Landing cone 164 includes a central recess for containing attachment means to the upper portion of drive shaft 34 for rotation of impeller assembly 30. Landing cone 164 and landing ring 166 are positioned directly beneath feed tube 18 through which the rock to be crushed is delivered onto the landing surface 136.

Feed tube 18 enters impeller assembly 30 through an annular opening 168 defined in upper plate 130. A downwardly depending annular flange 170 is attached to upper plate 130 within opening 168 so as to encircle feed tube 18. Flange 170 serves to provide a replaceable inner edge for upper plate 130, to restrict somewhat the upper apex of rock trapped within the impeller as will be described, and to restrict airflow through the gap around the feed tube 18 at its entrance to the impeller by trapping fine particles within the gap to the extent that the particles form a seal.

As these particles build up, they tend to abrasively wear away the lower portion of feed tube 18. Accordingly, a keyway 172 is formed within the exterior surface of feed tube 18 extending partially upward from its lower end. A key 174, formed of a hard material, such as tungsten carbide, is fitted within keyway 172 and acts as a scraper to keep dust accumulated between flange 170 and feed tube 18 from contacting the surface of feed tube 18. Of course, more than one such key 174 may be provided around the exterior of feed tube 18.

Referring now to FIGS. 4 and 6, a vertical baffle 180 is attached to the lower impeller plate 158 and to side wall 132 adjacent the forward side edge 182 of each exit opening 138. Each baffle 180 includes an L-shaped base portion 184 and L-shaped plates 186 attached to base portion 184 and extending upwardly and outwardly therefrom. Plates 186 thus define a gap therebetween into which is inserted a baffle segment 188 of a width substantially the same as the gap formed by plates 186. Baffle segment 188 is, therefore, held in place on base portion 184.

As impeller assembly 30 is rotated to hurl rock through exit openings 138 to the impact surface, a certain portion of the rock will be retained within impeller assembly 30 through the action of side wall 134 and lip bodies 142. Thus, as shown in FIG. 4, operation of impeller assembly 30 will cause accumulation of trapped rock in the configuration generally indicated as 190. Accumulation 190 extends from the outer edge of lip surface 144 to a relatively well defined apex 192, and then extends in a trailing direction to baffle 180. As rock being delivered to landing surface 136 is accelerated by impeller assembly 30, it will be driven against one of the rock accumulations 190 between apex 192 and lip surface 144. The rock will then be accelerated along the wall of rock defined by rock accumulation 190, after which it will be thrown from impeller assembly 30 through opening 138.

This general path for accelerated rock, it should be recognized, holds true regardless of whether the pathway is defined by a rock accumulation or by structural members within the impeller assembly. Thus, by providing lip bodies 142, the abrasive forces of the rock is largely imposed upon the face of rock accumulation 190 rather than impeller assembly 30. Consequently, a significant portion of wear within impeller assembly 30 is eliminated.

Notwithstanding the foregoing, a small but significant portion of the rock traverses the wall of rock accumulation 190 at or slightly above or below the upper and lower edges of openings 138. In impeller assemblies wherein the exit openings extend completely to the upper and lower impeller surfaces, this can result in substantial wear upon these surfaces. As a result, many impellers utilize wear plates to protect these surfaces, which must be periodically replaced.

In the present invention, however, as can be seen in FIG. 5, the upper and lower edges of each opening 138 are located remotely from upper plate 130 and lower plate 158 of the impeller assembly. Thus, the problem of wear along the upper and lower surfaces is eliminated since the distribution of moving rock along the face of the rock accumulations 190 will not extend sufficiently above or below the vertical positioning of the exit openings 138 to cause the rock to contact and wear either upper plate 130 or lower plate 158. Adjacent side wall 132, however, portions of the rock which approach exit openings 138 slightly above or slightly below exit openings 138 will be collected against side wall 132 above and below openings 138, as indicated by 194. These accumulation extensions 194 will occur even in the case of very dry material, due to the high centrifugal force placed upon the material by the rotation of impeller assembly 30. Thus, rocks which traverse the face of a rock accumulation 190 near the level of the upper or lower edges of an exit opening 138 will not cause wear along these edges of the exit opening since these edges are protected by accumulation extensions 194.

It should be recognized from the foregoing discussion that since upper plate 130 and lower plate 158 do not enter into contact with rock moving outwardly from landing surface 136, plates 130 and 158 are only necessary for maintaining the structure of the impeller assembly 30. Thus, plates 130 and 158 could be disposed even further from the upper and lower edges of the openings 138, of could be replaced entirely by, for example, an open framework or the like, so long as the rock accumulations 190 and extensions 194 are sufficiently supported.

While ideally the upper and lower edges of the exit openings 138 are protected from wear by accumulation extensions 194, ultimately some wear of these edges will occur. Rather than have this wear take place on a structural member of the impeller assembly 30, removable inserts 196 and 198 are provided adjacent the upper and lower edges of each exit opening 138 to absorb any wear which may occur. As seen in FIGS. 4 and 5, each insert 196 and 198 comprises a curved bar having notches 200 defined in each end of the bar. Mounting blocks 202 are attached to the inside surface of side wall 134 near the upper and lower edges of each exit opening 138. Inserts 196 and 198 are placed between a pair of mounting blocks 202 so that a block 202 fits within each slot 200. The centrifugal forces generated during rotation of impeller assembly 30 keeps the inserts 196 securely in place against side wall 134. Since wear along upper and lower edges of exit openings 138 will occur only near the rearward side edge due to material exiting along the rock accumulation 190, it will be noted that inserts 196 and 198 preferably extend only partially toward the forward side edge 182 of each exit opening 138.

It should be recognized that each baffle 180 serves to prevent the trailing edge of each rock accumulation 190 from interfering with the next adjacent exit opening 138. Thus, it has been found that with only two or three exit openings 138, the distance along side wall 134 between adjacent openings 138 enables baffles 180 to be dispensed with entirely. Similarly, the greater the number of exit openings 138, the further inward each baffle 180 must extend.

In addition, it has been found that, depending upon the particular rock being used within the crusher, the distance from which apex 192 of each rock accumulation 190 is spaced from the center of landing surface 136 will vary. Accordingly, it may be desirable to maintain a variety of sizes of baffle portions 188 for use with baffles 180. Portions 188 can then be selected depending upon the type of rock to crushed.

It will be seen from reference to FIG. 4 that end surface 146 of lip body 142 will be subject to wear since the rock will traverse end surface 146 after leaving the side wall of rock accumulation 190. Due to the presence of rock material against lip surface 144, however, wear on end surface 146 will tend toward the outer edge of the surface. Thus, the corner formed by lip surface 144 and end surface 146 will be preserved for a relatively long period, ensuring continued presence of rock accumulations 190. To provide for increased life for end surfaces 146, an insert 204 formed from a hard material, such as tungsten carbide, is imbedded within the end of lip body 142. The insert 204 provides a working surface that is flush with end surface 146, so that there is no effect upon the path of rock being thrown from impeller assembly 30. Also, by having the tungsten carbide working surface flush with end surface 146, the brittle corners of the tungsten carbide are supported by the surrounding material which avoids early breakage of these corners and provides longer life.

Notwithstanding insert 204, it will eventually become necessary to replace lip bodies 142. At such times, it will be noted that the ease of removal and installation of lip bodies 142 from the impeller assembly 30 represents a significant advantage of the impeller assembly.

To provide further protection against wear within impeller assembly 30, landing surface 136, baffle segments 188, removable inserts 196 and 198, and lip bodies 142 may be formed from a material such as abrasion-resistant alloy white cast iron.

It has been found that the angle formed between end surface 146 and an imaginary line 208 passing through the center of impeller assembly 30 and the outer edge of end surface 146 or, alternatively, the angle between lip surface 144 and such a line, has a significant effect upon the performance and wear characteristics of impeller assembly 30. In general, it has been found that an angle 206 between end surface 146 and line 208 within a range of approximately 15° to 45°, and preferably by 30°, is desirable. An angle 206 of less than this range will likely provide a lip surface 144 which is insufficient to maintain a rock accumulation that provides adequate protection for the rearward side edge of the exit openings 138. From FIG. 4, it will be noted that, at the angle 206 shown therein, centrifugal force exerted upon rock particles against lip surface 144 creates a substantial tangential component along surface 144 for retaining rock against lip body 142. As the angle is decreased, however, the tangential component is accordingly reduced so that occasional perturbations in rock particle movement along the side wall of rock accumulation 190 could cause occasional disintegration of the wall along lip surface 144, resulting in premature wear. It will also be seen that reductions in angle 206 could result in the portion of the lip body 142 near pin 154 being exposed through the side wall of rock accumulation 190.

As the angle is increased beyond this range, it should be recognized that the wearing force on end surface 146 is increased, since the component of force into surface 146 caused by centrifugal force upon rock particles moving therealong is increased. As a result, the useful lifetime of the lip bodies 142 will be reduced.

While the form of apparatus herein described constitutes a preferred embodiment of the invention, it is to be understood that the invention is not limited to this precise form of apparatus and that changes may be made therein without departing from the scope of the invention.

What is claimed is:

1. In a centrifugal impact rock crusher including a cylindrical housing with a vertically disposed central axis, means defining an impact surface positioned radially around the interior of said housing and transverse to said central axis, a housing cover for attachment to said housing having a circular housing feed opening defined therein concentric with said axis, impeller means having a landing surface therein, disposed for rotation concentrically within said housing and adapted to throw rock received upon said landing surface against said impact surface for crushing, and an impeller cover for attachment to said impeller means having a circular impeller feed opening defined therein concentric with said axis and of a diameter substantially equal to the diameter of said housing feed opening, the improvement comprising:

a hopper having at least one side wall with upper and lower edges and defining a circular exit opening at the bottom of said hopper having a diameter substantially equal to the diameters of said housing feed opening and said impeller feed opening;

means supporting said hopper with said exit opening disposed above and concentric with said housing feed opening;

a cylindrical feed tube having upper and lower ends of a diameter slightly less than the diameters of said exit opening, said housing feed opening and said impeller feed opening, and of a height greater than the distance between said exit opening and said impeller feed opening but less than the distance between said upper edge of said hopper side wall and said landing surface of said impeller, said feed tube being disposed in vertical orientation to pass through said exit opening and said housing feed opening and into said impeller feed opening with said upper end within said hopper and said lower end at or below said impeller feed opening; and means for releasably securing said feed tube to said housing cover to permit downward adjustment of said feed tube as said bottom end thereof wears.

2. The crusher as defined in claim 1 wherein said hopper further includes a bottom member attached substantially at said lower edge of said side wall, said bottom member defining said exit opening therethrough with said exit opening remote from said lower edge of said side wall.

3. The crusher as defined in claim 1 wherein said releasable feed tube securing means includes an encircling clamp attachable about said feed tube and means for attaching said clamp to said housing cover.

4. The crusher as defined in claim 3 wherein said clamp includes first and second identical halves, each of said halves having a semi-cylindrical flange with first and second ends and vertical radial flanges extending from said first and second ends perpendicular to said semi-cylindrical flange, said clamp halves being attachable about said feed tube by placement of said semi-cylindrical flanges against the exterior of said tube and connection of adjacent ones of said vertical radial flanges.

5. The crusher as defined in claim 4 wherein said means for attaching said clamp to said housing cover includes a horizontal flange extending outwardly from each of said semi-cylindrical flanges along at least a portion thereof and having a plurality of openings defined therethrough, a plurality of threaded studs mounted to said housing cover to extend upward therefrom for cooperation with said openings in said horizontal flanges, and a pair of nuts for each of said studs for placement of one of said nuts on each side of the respective one of said horizontal flanges to secure said clamp halves to said studs.

6. The crusher as defined in claim 1 wherein the improvement further comprises at least one keyway defined in vertical orientation along the exterior of said feed tube and extending from said bottom end thereof through said impeller feed opening at least partially along the height of said tube, and a scraper key fitted within each of said keyways and extending therefrom radially with respect to said feed tube to a distance insufficient to cause said key to contact the edge of said impeller feed opening.

7. The crusher as defined in claim 6 wherein said scraper key is constructed of a tungsten carbide material.

* * * * *